US005826338A

United States Patent [19]

Chilton et al.

[11] Patent Number: 5,826,338

[45] Date of Patent: Oct. 27, 1998

[54] WIRE CUTTER STRUCTURE FOR MULTIPURPOSE TOOL

[75] Inventors: Richard A. Chilton, Oregon City; Douglas M. Stapp, West Linn, both of Oreg.

[73] Assignee: Leatherman Tool Group, Inc., Portland, Oreg.

[21] Appl. No.: 863,057

[22] Filed: May 23, 1997

Related U.S. Application Data

[63] Continuation of Ser. No. 374,310, Jan. 17, 1995, abandoned.

[51] Int. Cl.[6] ..... B21F 11/00

[52] U.S. Cl. ..... 30/90.1; 30/91.2; 30/131; 30/252; 30/258; 81/9.4; 7/131

[58] Field of Search ..... 7/125, 127, 129–135; 30/90.1, 91.2, 131, 134, 145, 146, 186, 187, 191, 194, 244, 250, 252, 254, 257, 258; 81/9.4

[56] References Cited

U.S. PATENT DOCUMENTS

| | | | |
|---|---|---|---|
| 667,914 | 2/1901 | Klever, Jr. . | |
| 753,048 | 2/1904 | Des Moineaux | 7/131 X |
| 871,585 | 11/1907 | Haeberli . | |
| 1,388,398 | 8/1921 | Adams . | |
| 1,771,733 | 7/1930 | Ott | 30/90.1 X |
| 1,924,837 | 8/1933 | Crause | 81/9.5 |
| 2,431,970 | 12/1947 | Swartz | 30/186 |
| 3,078,485 | 2/1963 | Carter | 15/104.02 |
| 3,120,773 | 2/1964 | Esser | 81/15 |
| 3,461,555 | 8/1969 | Bliznak | 30/254 |
| 3,871,078 | 3/1975 | Ogle | 30/90.1 |
| 3,947,905 | 4/1976 | Neff | 7/131 X |
| 4,059,892 | 11/1977 | Siden | 30/90.1 |
| 4,226,145 | 10/1980 | Gill | 30/90.1 |
| 4,607,544 | 8/1986 | Jewell, Jr. | 30/90.1 X |
| 4,888,869 | 12/1989 | Leatherman | 30/161 |

FOREIGN PATENT DOCUMENTS

| | | |
|---|---|---|
| 537119 | 9/1923 | France . |
| 460990 | 2/1975 | Russian Federation . |

*Primary Examiner*—D. S. Meislin
*Attorney, Agent, or Firm*—Chernoff, Vilhauer, McClung & Stenzel, LLP

[57] ABSTRACT

A multipurpose tool may have several tool elements which pivot into storage positions in profiled handles attached to one of a pair of pliers jaws. A wire-cutter portion of each pliers jaw includes a sharp edge and a notch located at the throat of the pair of jaws, adjacent the sharp edge. The notches face toward each other to support and shear wire, but the bottoms of the notches are prevented from passing each other so that bulging material at the bottoms of the notches does not cause the jaws to bind against each other.

18 Claims, 7 Drawing Sheets

WIRE CUTTER STRUCTURE FOR MULTIPURPOSE TOOL

This application is a continuation of application Ser. No. 08/374,310 filed on Jan. 17, 1995, now abandoned.

BACKGROUND OF THE INVENTION

This invention relates to a wire cutter arrangement for a hand tool and more particularly to wire cutter portions of pliers jaws of a compact multipurpose tool.

Compact multipurpose hand tools, of which the types shown in Leatherman U.S. Pat. No. 4,888,869, Frazer U.S. Pat. No. 5,267,366, and Sessions et al. U.S. Pat. No. 5,142,721 are examples, include pliers, handles, and other tool elements arranged in such a way that the size of the tool is reduced when it is not in use. The pliers in such tools, to provide added functions for the user, preferably include wire cutters, and for ease of manufacture, the wire cutters preferably have blades with sharp edges which pass by each other in scissors fashion.

These wire cutters work well and cleanly cut wires whose hardness is significantly less than the hardness of the wire cutters; however, when used to cut wires whose hardness approaches that of the edges of the wire cutter blades, the wire cutter edges may be deformed, causing the blades of the wire cutter to bind against each other and tending to hold the pliers including such blades in a closed position. This can render the tool very difficult to use.

Additionally, the straight edges of such scissors-action wire cutters often tend to squeeze wire away from the fulcrum of the jaws before beginning to cut it, thus reducing the mechanical advantage available through the pliers handles.

Haeberli U.S. Pat. No. 871,585 discloses pliers which include a wire cutting notch in the throat of a pair of scissors-action shearing blades, but the wire cutting notches have their openings extending generally radially outward, away from the pivot axis of the pliers, and the wire cutting notches move entirely past one another, so that in using such pliers to cut wire approaching the hardness of the material of the tool itself, it is likely that deformation of the material defining the notches "j" would result in added friction between the jaws of the pliers.

Klever, Jr. U.S. Pat. No. 667,914 discloses a multipurpose scissors tool whose handles include a pair of wire cutter notches "g" whose open mouths are directed radially away from the pivot axis of movement of the handles with respect to each other. As in the Haeberli tool, deformation of the material defining the wire cutter notches is likely to cause the tool parts to bind against each other.

What is needed in a hand tool, then, is an improved scissors-action wire cutter intended to cut hard wire, yet which is less susceptible than those of previously known wire cutters to having one wire cutter portion become bound against its mate; and in particular such an improved wire cutter is desired for a compact multipurpose tool.

SUMMARY OF THE INVENTION

The present invention overcomes the aforementioned shortcomings and disadvantages of prior art wire cutters and provides a wire cutter portion for a tool having a pair of jaws pivoted for movement with respect to each other in pliers fashion, in which a pair of notches defined by the jaws hold a wire and shear it apart, but are deep enough so that they continue to define an opening between their opposed interior surfaces when the jaws are in a fully closed position.

In one embodiment of the invention the notches are defined in a pair of wire cutter blades, adjacent sharp edges which interact with each other in scissors fashion, with the notches being located near the jaw pivot axis about which the wire cutter blades move with respect to each other.

In one embodiment of the invention the wire cutter is included in a pliers portion of a compact multipurpose tool.

It is an important advantage of the wire cutter of the present invention that it can cut hard wires without thereby causing its blades to bind against each other and be difficult to open.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
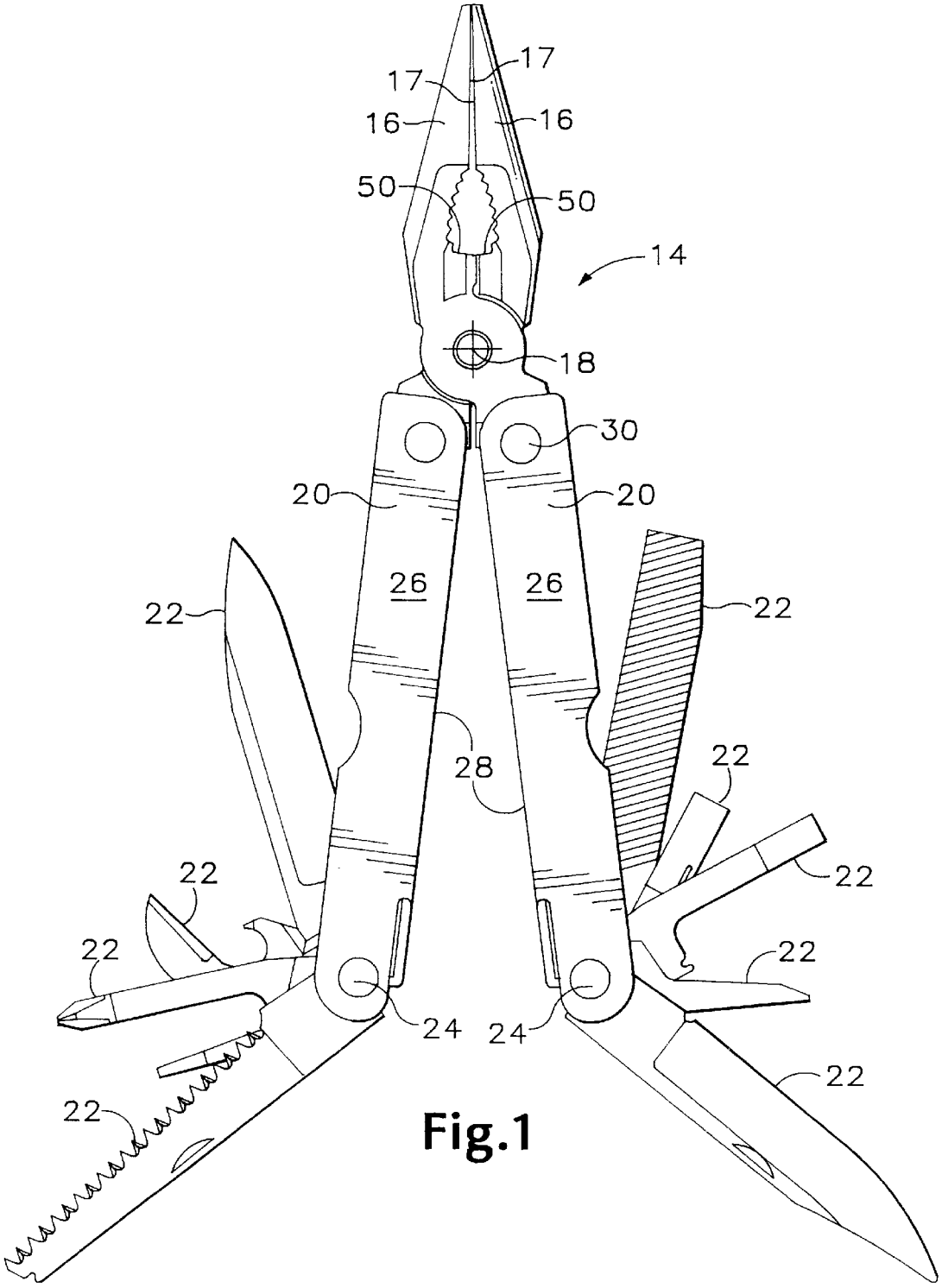
FIG. 1 is a side view of a compact multipurpose tool including pliers jaws incorporating wire cutter blade portions according to the present invention.
Figure 2:
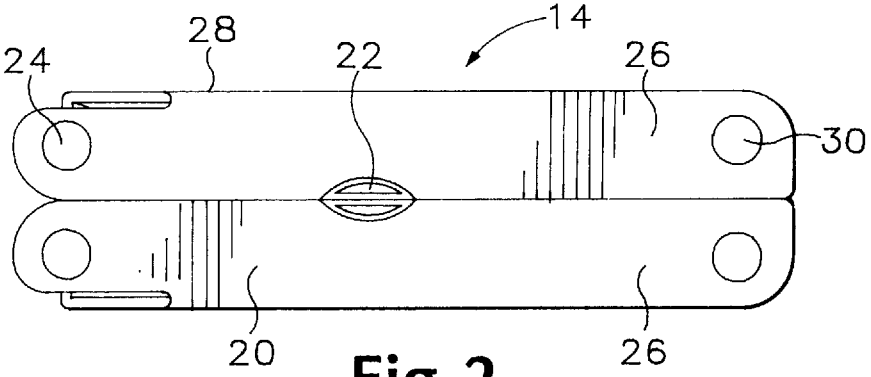
FIG. 2 is a side view of the tool shown in FIG. 1, showing the tool in its most compact form.
Figure 3:
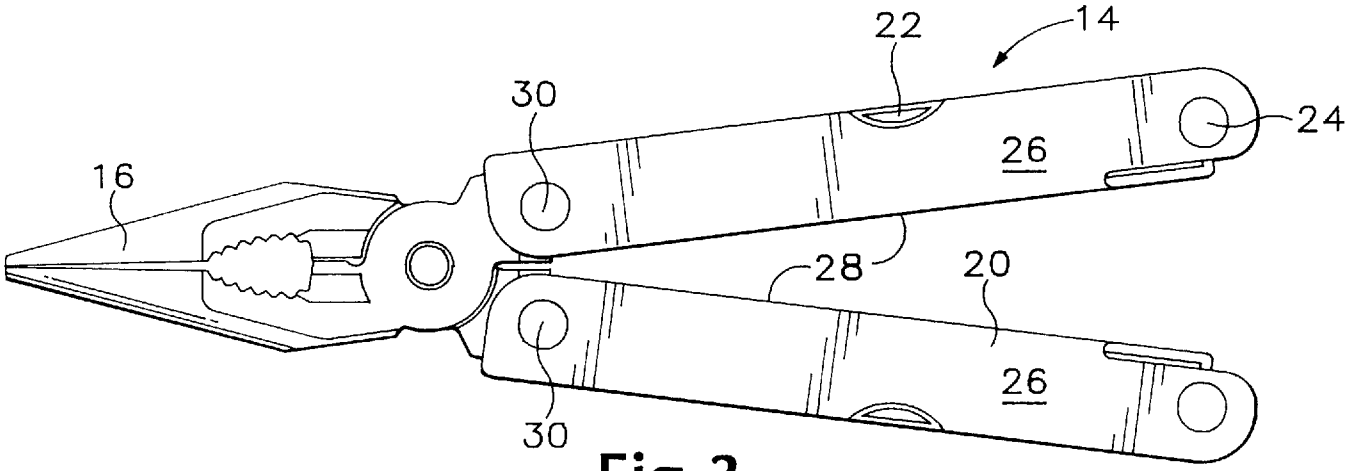
FIG. 3 is a side view of the multipurpose tool shown in FIGS. 1 and 2, ready for use as pliers, with the other tool elements folded into position for storage within the handles of the tool.
Figure 4:
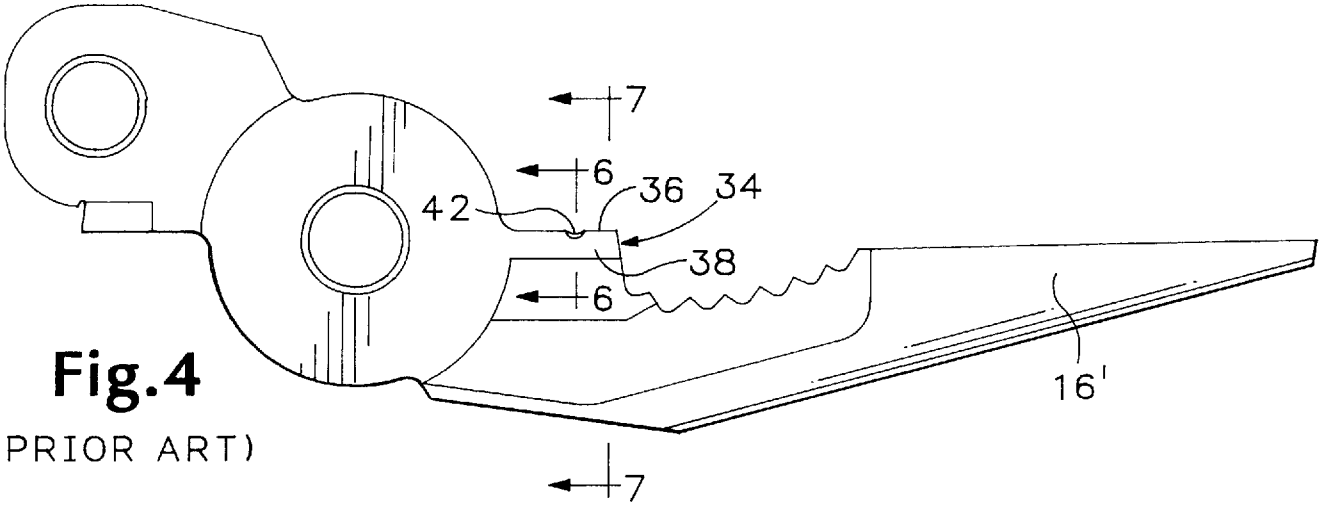
Fig.4 (PRIOR ART)
FIG. 4 is a side view of one of the pliers jaws of a prior art tool similar to the tool shown in FIGS. 1–3, but without the improved wire cutter blades of the present invention, and showing an indentation caused by cutting hard wire.
Figure 5:
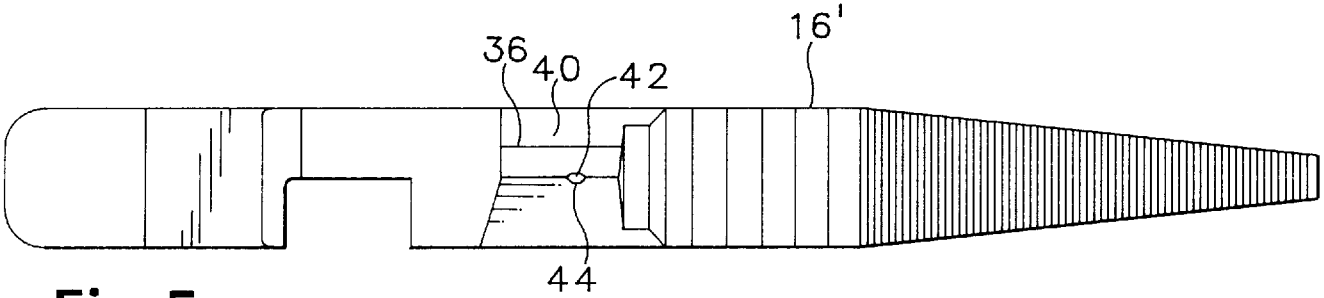
Fig.5 (PRIOR ART)
FIG. 5 is a top view of the pliers jaw shown in FIG. 4.
Figure 6:
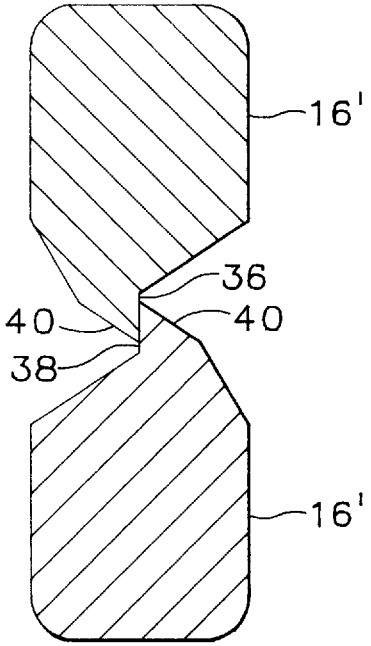
Fig.6 (PRIOR ART)
FIG. 6 is a section view of a pair of pliers jaws of the type shown in FIG. 4, taken along the line 6—6 of FIG. 4 and on a corresponding plane in the other, mating, jaw, showing the jaws, in an ideal situation according to the prior art, in a closed position in which the wire cutter blade edges overlap in scissors fashion.

FIGS. 1, 2 and 3 show a compact multipurpose tool 14 including the improved wire cutter blade configuration of the present invention. It should be noted that, although FIGS. 1, 2, and 3, and subsequent description thereof, do describe one type of compact multipurpose tool, application of the preferred embodiment is not limited to tools of that particular configuration. Moreover, the present invention is intended to encompass all types of multipurpose tools, wire cutting pliers, wire cutters, and metal shears which incorporate a scissors-type cutting action. The tool 14 includes a pair of pliers jaws 16, connected to each other pivotally by a conventional jaw pivot joint defining a pivot axis 18. Each jaw 16 has an associated handle member 20. Each handle member 20 of the tool 14 houses several tool elements 22 which pivot independently of one another about a respective pin 24 located at an outer end of each of the handle members 20. The handle members 20 are constructed of profiled sheet metal, each having a pair of parallel sidewalls 26 interconnected by the base 28, which serves as the back of the handle member 20. The pins 24 are mounted in and extend between the sidewalls 26 to attach the respective tool blades 22 to each handle member 20.

Each handle member 20 is connected to a respective one of the jaws 16 by a jaw handle pin defining a pivot axis 30. The tool elements 22 are located in respective storage positions within the profiled handle members 20, as shown in FIG. 2. The tool 14, when closed, is relatively small and has a convenient exterior shape to be carried in a pocket of one's clothing.

As shown in FIG. 3, when the jaws 16 are extended with respect to the handle members 20 and the tool blades 22 are all stored within the profiled handle members 20, the multipurpose tool 14 is conveniently useful as a pair of pliers including wire cutters.

Figure 7:
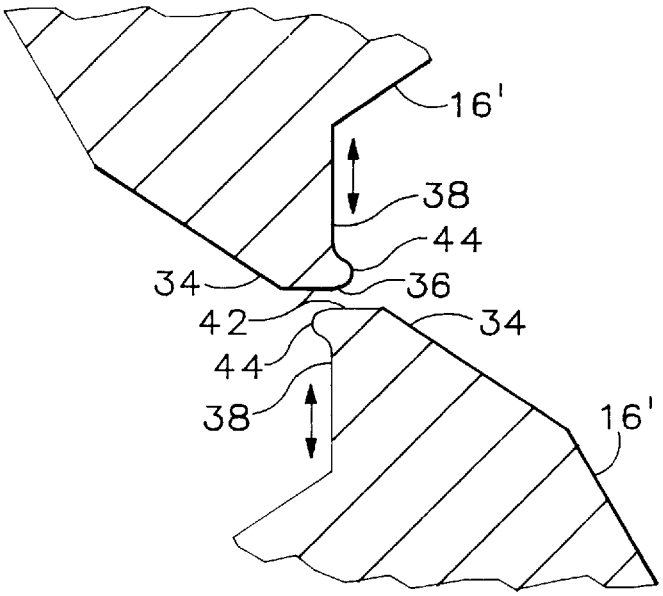
Fig.7 (PRIOR ART)
FIG. 7 is a detail sectional view at an enlarged scale, taken along line 7—7 of FIG. 4, of a pair of jaws which have been deformed in the manner illustrated in FIGS. 4 and 5, with the jaws in a slightly open position with respect to each other.

As shown in FIGS. 4, 5, 6 and 7, prior art compact multipurpose tools similar in many respects to the tool 14 also include pliers jaws 16', which include wire cutter portions. Each jaw 16' includes a wire cutter portion 34 having a sharp edge 36 defined along the intersection of a flat inner face 38 with a flat outer face 40. The inner faces 38 of a pair of such jaws 16' are substantially coplanar, so that pivoting the jaws 16' toward each other results in scissors-like interaction of the wire cutter portions 34, with their sharp edges 36 sliding past each other toward an overlapping relationship and defining a cutting plane. Each sharp edge 36 is forced into the surface of a wire being cut, acting as a knife at the same time the wire cutter portions 34 are also placing opposing shearing forces on the wire being cut. When cutting wires whose hardness approaches that of the sharp edge 36, not only is the wire deformed and ultimately cut, but the metal of the wire cutter portion 34 is likely to be upset as well, as shown at 42. Not only does the upset portion 42 result in a reduced sharpness of the edge 36 at that location, but some of the upset material 44 is displaced laterally, in the direction of the inner face 38 of the other wire cutter portion 34. As shown in FIG. 7, the laterally displaced material 44 associated with each sharp edge 36 thereafter rubs against the inner face 38 of the opposing wire cutter portion 34, increasing the amount of friction which must be overcome in moving the jaws 16' relative to each other in either direction.

While the additional force required to overcome such friction can often be provided by the user when opening and closing the jaws, the additional friction is often objectionable to the user and also causes the tips of the jaws to be laterally offset from each other, reducing the precision of the needlenose pliers jaws 16' of the tool.

The wire cutter of the present invention, as shown in FIGS. 8–13, includes a pair of jaws 16 including wire cutter blades 50 each including a sharp edge 52 formed along the intersection between an inner face 54 and an outer face 56. The inner faces 54 are substantially parallel and coplanar, so that they slide past each other in scissors fashion in the same manner as in the prior art wire cutter portions 34 shown in FIG. 6, defining a cutting plane 58.

At the radially inner end of each wire cutter blade 50, that is, at the end of the sharp edge 52 closer to the jaw pivot axis 18, is a crescent-shaped notch 60 defined by each wire cutter blade 50. The notches 60 are thus located immediately adjacent a hub portion 61 that surrounds the jaw pivot axis 18 of each jaw 16, as may be seen best in FIGS. 9 and 10. While the notches 60 shown in the drawings of the present application are shown as having open mouths facing toward each other, and as being in the shape of circular arcs, other shapes could also be used.

Figure 11:
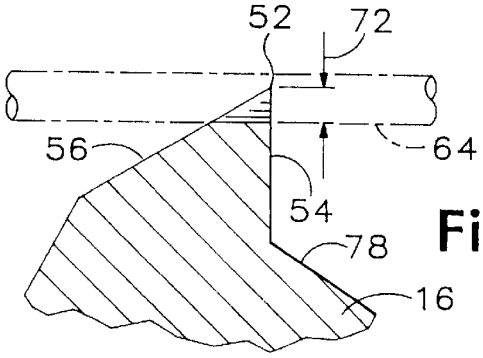
FIG. 11 is an enlarged section view of a detail of one of the jaws shown in FIG. 10, taken along line 11—11.
Figure 12:
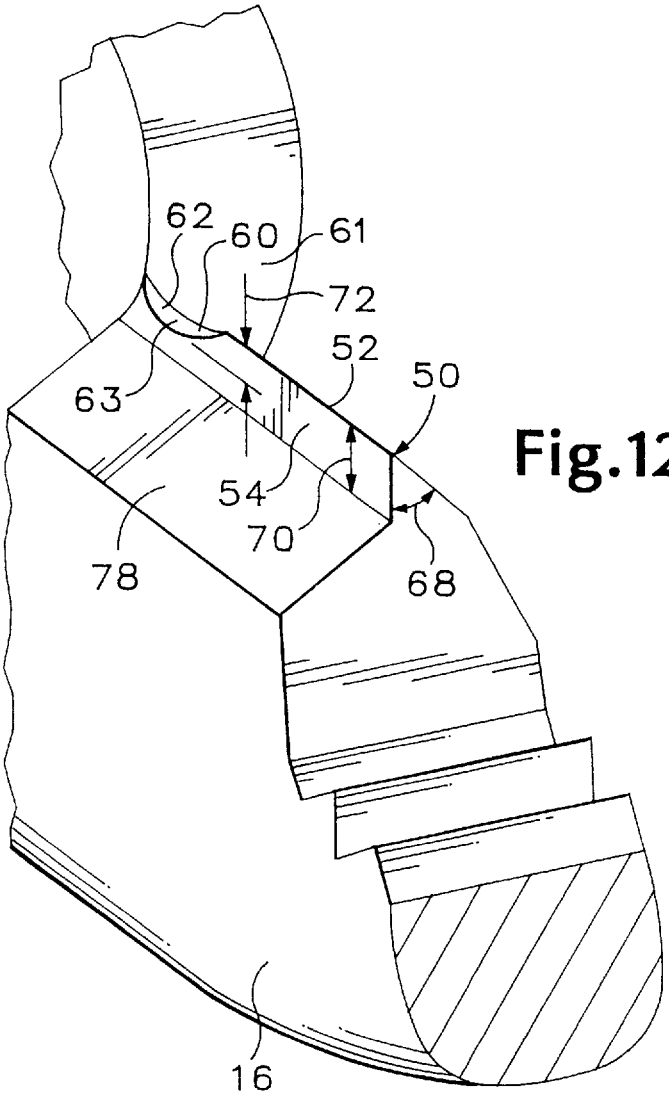
FIG. 12 is a perspective view, at an enlarged scale, of a portion of one of the jaws shown in FIG. 10, showing the configuration of the notch for use in cutting hard wire.

As shown best in FIGS. 11 and 12, the notches 60 are defined by generally cylindrical surfaces 62, including bottom surfaces 63, extending transversely with respect to the jaws 16, substantially normal to the respective inner face 54. The cylindrical surfaces 62, then, and especially the bottom surfaces 63, rather than acting as knife edges to cut into the surface of a wire (such as the wire 64 shown in FIG. 10 and shown in phantom view in FIG. 11), provide support against the surfaces of the wire 64 over a significant area. Thus, the cylindrical surfaces 62 of the two notches 60 act on opposite sides of a wire such as the wire 64 to shear it apart along the cutting plane 58.

Figure 8:
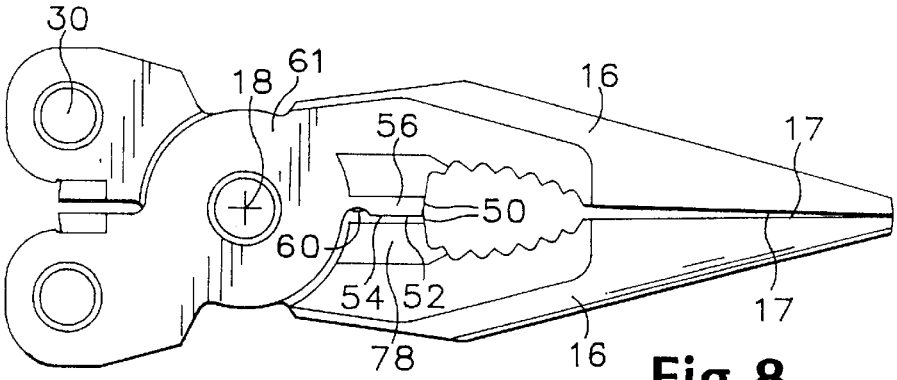
FIG. 8 is a side view of a pair of pliers jaws according to the present invention including wire cutter portions each defining a notch according to the present invention.
Figure 9:
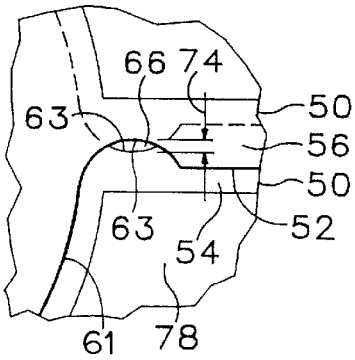
FIG. 9 is a view, at an enlarged scale, of a detail of the pair of pliers jaws shown in FIG. 8.
Figure 10:
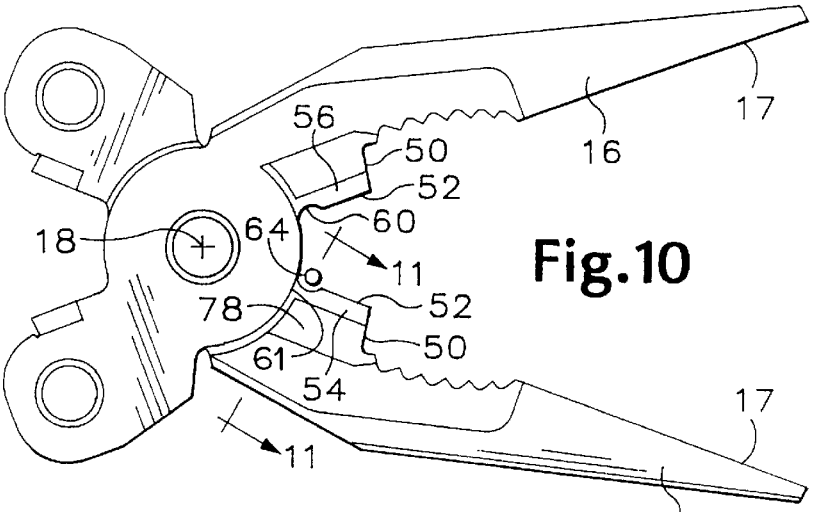
FIG. 10 is a side view of the pliers jaws shown in FIG. 8 in an open position with respect to each other.
Figure 13:
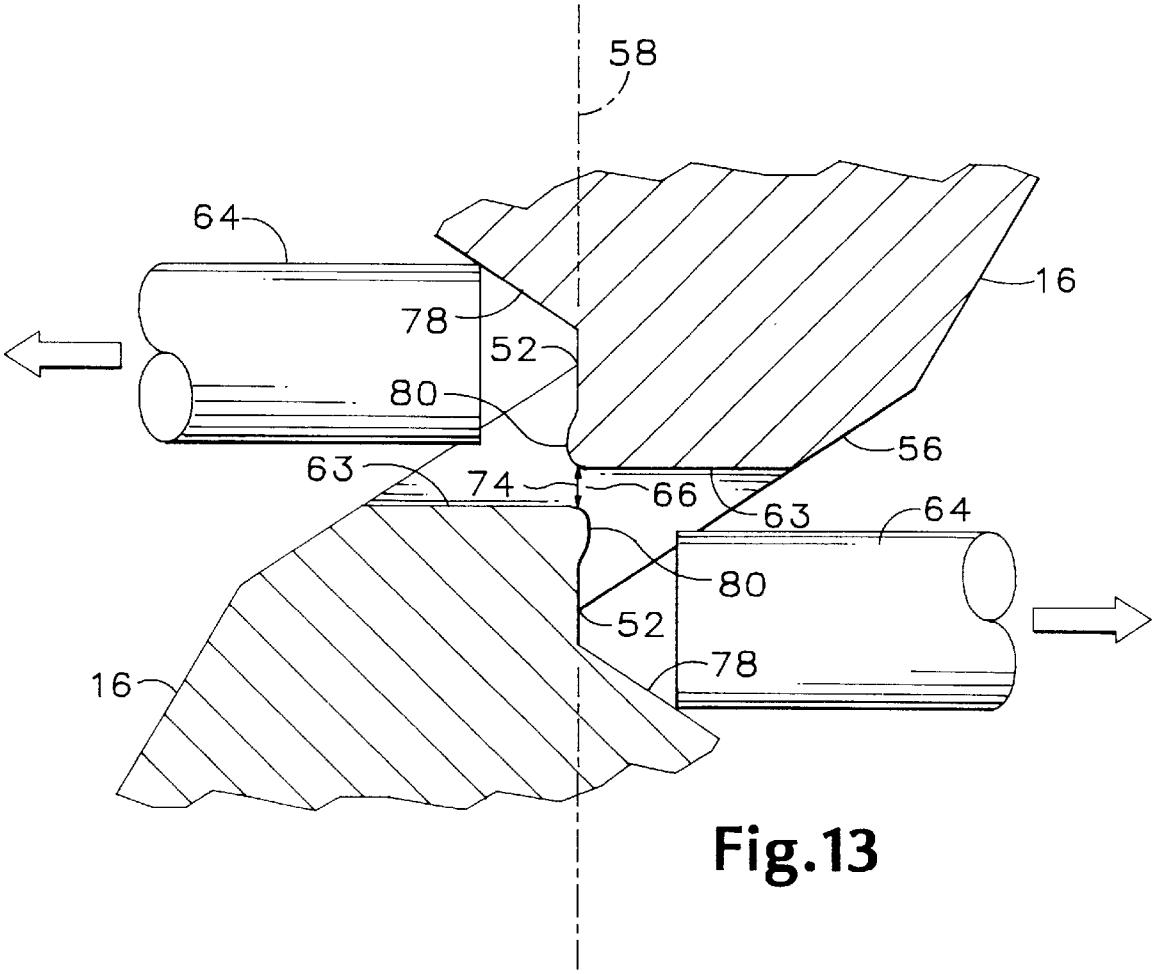
FIG. 13 is a section view at an enlarged scale, taken in the same plane as FIG. 11, showing both wire cutter blades after use to cut hard wire with the jaws in a closed position.

Referring particularly to FIGS. 8, 9 and 13, it will be seen that the bottom surfaces 63 of the notches 60 do not pass entirely by each other when the jaws 16 of the pliers portion of the tool 14 are moved to the fully closed position, with gripping faces 17 in contact with each other. Instead, a small amount of clearance is left between the opposed bottom surfaces 63 so that the notches 60 define an opening 66 through the cutting plane 58.

In a preferred embodiment of the invention, the pliers jaws 16 are shaped by conventional methods so that the inner face 54 and outer face 56 define the sharp edge 52, and the notch 60 is provided in each jaw 16. The sharp edge 52 of the wire cutting blade 50 may include an angle 68 of between 45° and 75°, and includes an angle 68 of about 60°, for example, in one embodiment of the invention, between the inner face 54 and the outer face 56. The inner face 54 in such an embodiment of the invention has a height 70 of 1.52 mm (0.060 inch), while the crescent-shaped notch 60 has a depth 72 of 0.51 mm (0.020 inch), so that when the jaws 16 are in the fully closed position shown in FIG. 8, the opening 66 has a height 74 (FIG. 13) of 0.038 mm (0.0015 inch) before the wire cutter is used to cut very hard wire.

The height 74 of the opening 66 is thus small enough initially that wires of as small a diameter as are likely to be encountered in normal use are sheared sufficiently to fail by the time the jaws 16 are in the fully closed position shown in FIG. 13. Mechanical failure of the wire takes place primarily through shearing action, as parts of the wire 64 on opposite sides of the cutting plane 58 are moved in opposite directions along the cutting plane 58, supported by the cylindrical surfaces 62 defining the notches 60. The sloping lower faces 78 of the jaw 16 may also exert a force to push the wire 64 away from the cutting plane as indicated by the arrow in FIG. 13, depending on the size of the wire 64.

The notches 60, by extending around a portion of a wire, prevent the wire from sliding outwardly along the wire cutter blades 50 in a radial direction away from the jaw pivot axis 18. As a result, cutting of hard wires such as the wire 64 takes place as close as possible to the jaw pivot axis 18, making use of the maximum mechanical advantage available through the handle members 20.

Because the bottom surfaces 63 of the notches 60 do not pass each other on the cutting plane 58, as the jaws 16 rotate with respect to each other about the pivot axis 18, any deformation of the material surrounding the notches 60, as shown at 80 in FIG. 13, bulges into the opening 66 when the jaws 16 are in their fully closed position also shown in FIGS. 8 and 9. As a result, even though the bottom surfaces 63 defining the notches 60 may be deformed slightly as a result of the forces imposed by the action of cutting a wire 64 whose hardness approaches that of the material of the jaws 16, the resulting deformity will not cause the jaws 16 to interfere with one another and resist opening the wire cutter jaws after such a hard wire 64 has been cut.

The invention additionally avoids having such jaw interference offset the precise alignment of the needlenose tips of the jaws 16. As a result, the pliers jaws 16 of a compact tool 14 such as that shown in FIGS. 1–3 can easily be opened without worry that the handle members 20 will rotate inappropriately with respect to the jaws 16, about the jaw handle pin pivot axes 30, after the wire cutter blades 50 have been used to cut hard wires.

At the same time, moreover, the sharp edges 52 of the wire cutter blades 50 remain available for scissors-action cutting of soft wires or very small diameter wires, or for use on a limited basis to cut sheet material.

Finally, the notches 60 add an improved wire stripping capability to the compact multipurpose tool 14.

The terms and expressions which have been employed in the foregoing specification are used therein as terms of description and not of limitations, and there is no intention, in the use of such terms and expressions, of excluding equivalents of the features shown and described or portions thereof, it being recognized that the scope of the invention is defined and limited only by the claims which follow.

What is claimed is:

1. An improved hand-operated wire cutter, comprising:

(a) a pair of jaws movable with respect to each other about a pivot axis, between an open position and a closed position;

(b) a respective wire cutter portion included in each said jaw, each said wire cutter portion including an inner face and an outer face, said inner faces cooperatively defining a cutting plane extending parallel therewith and said outer face of each said wire cutter portion intersecting said inner face thereof in an acute angle defining a sharp edge, said sharp edges passing closely alongside each other in said cutting plane in scissors fashion as said jaws move from said open position to said closed position, and respective portions of said inner faces overlapping and being in close proximity to each other when said jaws are in said closed position; and (c) each said wire cutter portion including a notch located adjacent to said sharp edge and having a bottom surface extending substantially normal to said cutting plane and intersecting said inner face, said notches being located alongside each other and said bottom surfaces being separated from each other and defining an opening through said cutting plane when said jaws are fully in said closed position.

2. The wire cutter of claim 1, each said notch having an open mouth, said open mouths of said notches facing toward each other when said jaws are in said open position with respect to each other.

3. The wire cutter of claim 1 wherein said notches have arcuate paths of movement about said pivot axis and are oriented tangentially with respect to said paths of movement.

4. The wire cutter of claim 1, including a lower face located adjacent and sloping downwardly away from said inner face.

5. The wire cutter of claim 1 wherein each said notch is located adjacent a radially inward end of said sharp edge.

6. The wire cutter of claim 1 wherein each of said pair of jaws has a respective hub portion surrounding said pivot axis and each said notch is immediately adjacent said hub portion of the respective jaw.

7. The wire cutter of claim 1 wherein each said notch also intersects said outer face of the wire cutter portion of the respective jaw.

8. A compact multipurpose tool, comprising:

(a) a pair of jaws interconnected with each other and pivoted with respect to each other about a jaw pivot axis, between an open position and a closed position;

(b) a respective wire cutter portion included in each said jaw, each said wire cutter portion including an inner face and an outer face, said inner faces cooperatively defining a cutting plane extending parallel therewith and said outer face of each said wire cutter portion intersecting said inner face thereof in an acute angle defining a sharp edge, said sharp edges passing closely alongside each other in said cutting plane in scissors fashion as said jaws move from said open position to said closed position, and respective portions of said inner faces overlapping and being in close proximity to each other when said jaws are in said closed position; and (c) each said wire cutter portion including a notch located adjacent to said sharp edge and having a bottom surface extending substantially normal to said cutting plane and intersecting said inner face, said notches being located alongside each other and said bottom surfaces being separated from each other and defining an opening through said cutting plane when said jaws are fully in said closed position.

9. The compact multipurpose tool of claim 8, each notch having an open mouth and said open mouths of said notches facing toward each other when said jaws are in said open position with respect to each other.

10. The compact multipurpose tool of claim 8 wherein said jaws are pliers jaws having opposed gripping faces which contact each other when said jaws are in said closed position with respect to each other.

11. The compact multipurpose tool of claim 8, including a pair of handles, each associated with a respective one of said jaws and connected thereto.

12. The multipurpose tool of claim 8 wherein each said notch is located adjacent a radially inward end of said sharp edge.

13. The multipurpose tool of claim 8 wherein each of said pair of jaws has a respective hub portion surrounding said pivot axis and each said notch is immediately adjacent said hub portion of the respective jaw.

14. The multipurpose tool of claim 8 wherein each said notch also intersects said outer face of the wire cutter portion of the respective jaw.

15. An improved hand-operated wire cutter, comprising:

(a) a pair of jaws movable with respect to each other about a pivot axis, between an open position and a closed position;

(b) a respective wire cutter portion included in each said jaw, each said wire cutter portion including an inner face and an outer face, said inner faces cooperatively defining a cutting plane extending parallel therewith and said outer face of each said wire cutter portion intersecting said inner face thereof in an acute angle defining a sharp edge, said sharp edges passing closely alongside each other in said cutting plane in scissors fashion as said jaws move from said open position to said closed position, and respective portions of said inner faces overlapping and being in close proximity to each other when said jaws are in said closed position; and (c) each said wire cutter portion including a notch located adjacent to said sharp edge and having a bottom surface extending substantially normal to said cutting plane and intersecting said inner face, said notches being located alongside each other and said bottom surfaces being separated from each other and defining an opening through said cutting plane when said jaws have moved far enough toward said closed position for respective portions of said sharp edges located adjacent said notches to have passed alongside each other in scissors fashion.

16. The wire cutter of claim 15 wherein each said notch is located adjacent a radially inward end of said sharp edge.

17. The wire cutter of claim 15 wherein each of said pair of jaws has a respective hub portion surrounding said pivot axis and each said notch is immediately adjacent said hub portion of the respective jaw.

18. The wire cutter of claim 15 wherein each said notch also intersects said outer face of the wire cutter portion of the respective jaw.

* * * * *